US005102016A

United States Patent [19]

Ball et al.

[11] Patent Number: 5,102,016

[45] Date of Patent: Apr. 7, 1992

[54] APPARATUS FOR DISPENSING MATERIALS IN TOUCHING ASSOCIATION AND METHODS OF USE THEREOF

[76] Inventors: Lee R. Ball; Norma L. Lee, both of 1525 N. Altadena Dr., Pasadena, Calif. 91104

[21] Appl. No.: 620,901

[22] Filed: Dec. 3, 1990

[51] Int. Cl.[5] ..... B67D 5/60

[52] U.S. Cl. ..... 222/145; 222/212; 239/304; 239/549; 425/131.1

[58] Field of Search ..... 222/94, 135, 136, 145, 222/206, 212, 215; 239/304, 549; 425/130, 131.1

[56] References Cited

U.S. PATENT DOCUMENTS

| | | | |
|---|---|---|---|
| 2,734,665 | 2/1956 | Flamm | 222/212 |
| 3,197,071 | 7/1965 | Kuster | 222/145 |
| 3,948,704 | 4/1976 | Evans | 222/94 |
| 4,089,437 | 5/1978 | Chutter et al. | 222/94 |
| 4,099,651 | 7/1978 | Von Winckelmann | 222/94 |
| 4,148,417 | 4/1979 | Simmons | 222/94 |
| 4,771,919 | 9/1988 | Ernst | 222/145 |
| 4,964,539 | 10/1990 | Mueller | 222/145 |
| 5,038,963 | 8/1991 | Pettengill et al. | 222/145 |

FOREIGN PATENT DOCUMENTS

| | | | |
|---|---|---|---|
| 1023317 | 12/1977 | Canada | 222/94 |
| 1396382 | 2/1964 | France | 222/94 |

*Primary Examiner*—Michael S. Huppert
*Assistant Examiner*—Kenneth Bomberg
*Attorney, Agent, or Firm*—Edward J. DaRin

[57] ABSTRACT

A resilient dispenser (30) for dispensing two flowable materials in touching association is provided. When the dispenser is squeezed the materials are dispensed through juxtaposed apertures such that the materials share a common boundary after dispensement. A removable spout (60) allows easy filling of the dispenser. Various embodiments (130,230,330, 430,530) are provided, some of which impart interesting patterns to the dispensed materials. The invention includes extension to more than two materials or restriction to one material. A method of use is provided.

2 Claims, 9 Drawing Sheets

APPARATUS FOR DISPENSING MATERIALS IN TOUCHING ASSOCIATION AND METHODS OF USE THEREOF

TECHNICAL FIELD

The present invention pertains to dispensers and more particularly, to flowable material dispensers.

BACKGROUND ART

Dispensers have been designed for a variety of materials and purposes. They include U.S. Pat. No. 3,239,105 to Woodson in which a partition has flexible envelope means bonded on each side. The envelope means have dispensing throats so that material can be expelled therefrom. U.S. Pat. No. 3,506,157 to Dukess has a closure device with two prongs for closing two apertures in a dispenser. U.S. Pat. No. 4,089,437 to Chutter concerns a collapsible container with a pressure barrier disposed between compartments so as to equalize compartment pressures resulting from a pressure imposed upon the container. U.S. Pat. No. 4,148,417 to Simmons involves a container with a plurality of compartments and nozzles for dispensing materials from the compartments. The container has sloping walls so as to facilitate an increased moment of force.

The patents referenced above dispense one or more materials. In addition, it is sometimes desirable to dispense materials in a specific position relative to each other. One such position is in touching association. That is, the materials dispensed upon a surface or object lie side by side and share a common boundary. A dispenser having this capability could be used, for example, to place one or more of mustard, relish, ketchup and mayonnaise on a hot dog or a hamburger. Peanut butter and jelly could be provided in such a dispenser to make it simpler to make a sandwich therefrom. Other uses could be for dispensing two or more salad dressings on a salad, garlic and cheese spreads on a bagel or various colors of icing on a cake.

DISCLOSURE OF INVENTION

The present invention is directed to apparatus and method for dispensing two or more flowable materials in touching association. Apparatus in accordance with the invention are characterized by two or more resilient compartments from which flowable materials can be dispensed from juxtaposed apertures. The juxtaposition of the apertures allows the materials to flow together after dispensement so that they share a common boundary.

In a preferred embodiment of the invention, a spout having passageways is removably mounted on a container having compartments. Each compartment has an outlet which communicates with one of the apertures in the spout. A recess in a divider that defines the passageways receives a wall that defines the outlets so that the outlets and passageways are aligned. The width of the divider is minimized so that the materials are dispensed from the juxtaposed apertures in touching association. A threaded ring is used to removably mount the spout to the container which has matching threads. A resilient cap is placed over the spout when not in use for environmental sealing.

In a second preferred embodiment a threaded spout has a divider, defining the passageways, that widens to a base where it abuts the wall that defines the compartments. The wide base covers the wall when the engaged position of the spout on the container changes due to manufacturing tolerances in the spout and container threads.

In a third preferred embodiment a resilient spout is provided with a ridge that snaps over a bead in the neck of the container. The passageways are aligned with the outlets by a relief in the bead matching a tab on the container neck.

In a fourth preferred embodiment, the divider of the spout twists as it progresses from its first side where it abuts the wall defining the compartments to its second side where it defines a portion of the apertures. This twist imparts interesting patterns to the dispensed materials while still dispensing them in touching association.

In a fifth preferred embodiment, the divider of the spout is divided by a gap into a first and a second divider. The first divider abuts the wall while the second divider defines a portion of the juxtaposed apertures. The second divider carries a truncated cone with the lesser end of the cone at the apertures. This embodiment has also been found to impart interesting patterns to the dispensed materials while still dispensing them in touching association.

In a sixth embodiment a pair of rotatable doors are fixed to the spout so that materials can be dispensed one at a time with one door open or in touching association, as with the other embodiments, with both doors open. When both doors are open apertures within them form an extension of the passageways of the spout.

The novel features of the invention are set forth with particularlity in the appended claims. The invention will be best understood from the following description when read in conjunction with the accompanying drawings.

BRIEF DESCRIPTION OF DRAWINGS

Incorporated as part of the description, in order to illustrate embodiments and principles of the present invention, are the accompanying drawings, wherein.

MODES FOR CARRYING OUT THE INVENTION

Figure 1:
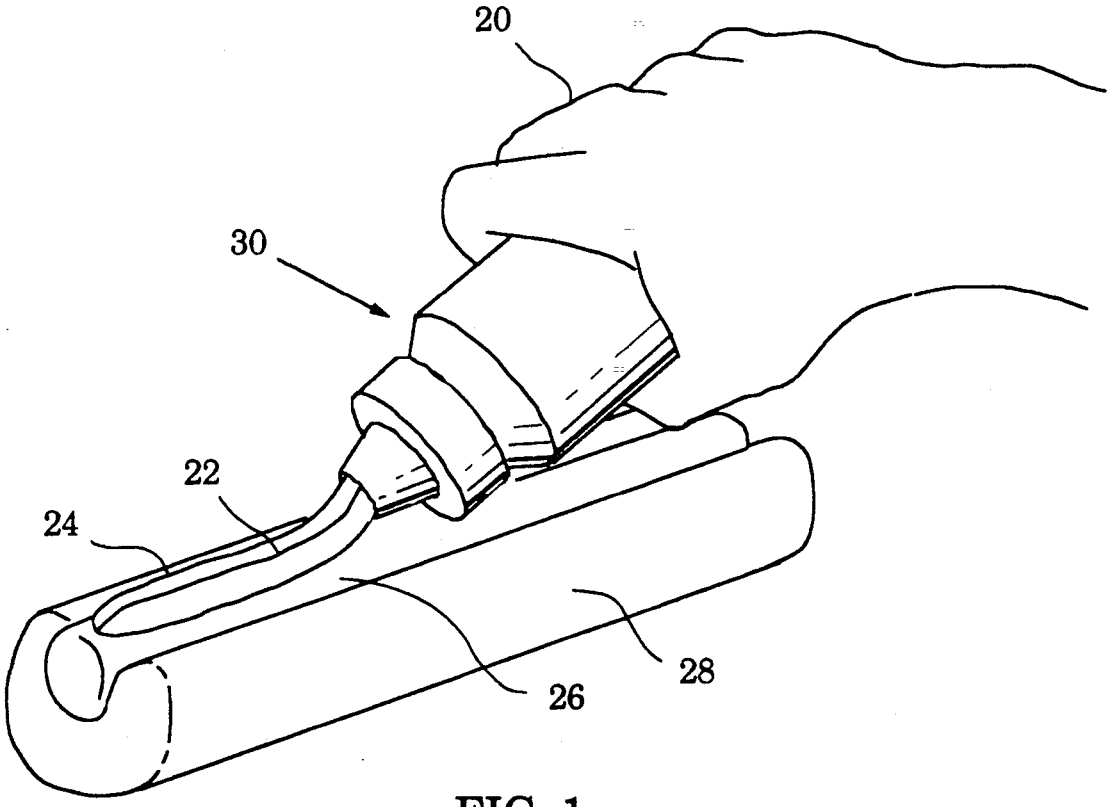
FIG. 1 is a perspective view, in accordance with an embodiment of the present invention, of a dispenser.

FIG. 1 is a perspective view, in accordance with an embodiment of the current invention, of a dispenser 30. The dispenser 30 is held and squeezed by the hand 20 to dispense two different flowable materials 22, 24 onto a frankfurter 26 in a bun 28. The materials 22, 24 are dispensed in touching association with each other. The materials 22, 24 in this illustration could be, as an example, chosen by the user of the dispenser 30 from the group of mustard, ketchup, relish and mayonnaise.

Figure 2:
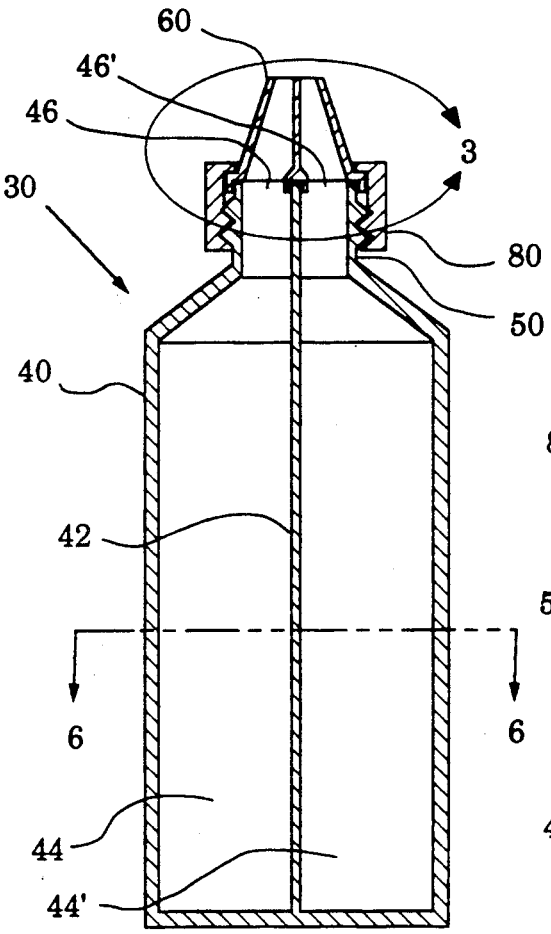
FIG. 2 is a sectional elevation view of the dispenser of FIG. 2.

FIG. 2 is a sectional elevation view of the dispenser 30. A resilient container 40 has an inner wall 42 that creates two compartments 44, 44'. Each compartment has an outlet 46, 46' which are juxtaposed. Flowable materials placed in the compartments 44, 44' can be ejected through the outlets 46, 46', in touching association, by squeezing the resilient container 40 as illustrated in FIG. 1. In order to conveniently fill the compartments 44, 44' with materials, the outlets 46, 46' need to be larger than is optimum for dispensing purposes. Use of a spout 60 allows the size of the outlets 46, 46' to be dictated by the need for filling of the compartments 44, 44'. The spout 60 is mounted to the neck 50 of the container 40 with a ring 80.

Figure 3:
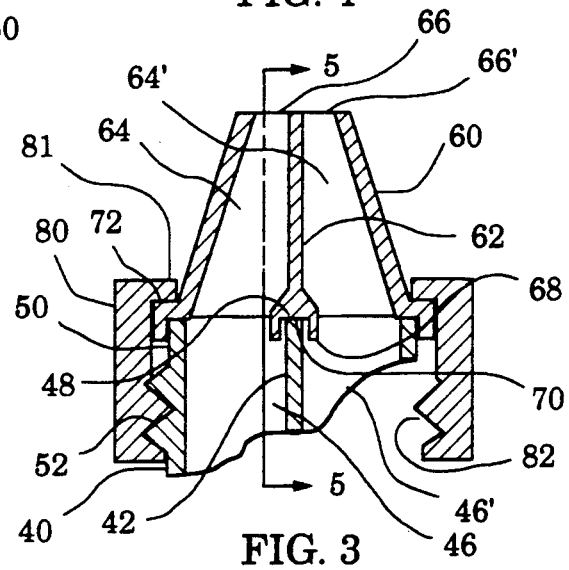
FIG. 3 is an enlarged view of the area enclosed by the line 3 of FIG. 2.

FIG. 3 is an enlarged view of the area enclosed by the line 3 in FIG. 2. FIG. 3 shows that the spout 60 has a divider 62 which defines two passageways 64, 64' leading to two apertures 66, 66'. The apertures 66, 66' are juxtaposed so that flowable materials ejected from them will lie side by side in touching association. The divider 62 has a first side 68 which has a recess 70. The inner wall 42 of the container 40 has an edge 48. When the spout 60 is placed with the edge 48 received in the recess 70 the divider 62 is automatically aligned with the inner wall 42. In this position of the spout 60 the first side 68 also abuts the edge 48. Thus the passageways 64, 64' are aligned with the outlets 46, 46'.

The spout 60 has a step 72. The spout 60 is removably mounted to the neck 50 of the container 40 by a ring 80 having a flange 81 which is urged against the step 72 by the interaction of the ring threads 82 and the neck threads 52. This interaction is obtained when the ring 80 is rotated relative to the neck 50 in the well known method of using threaded devices.

Figure 4:
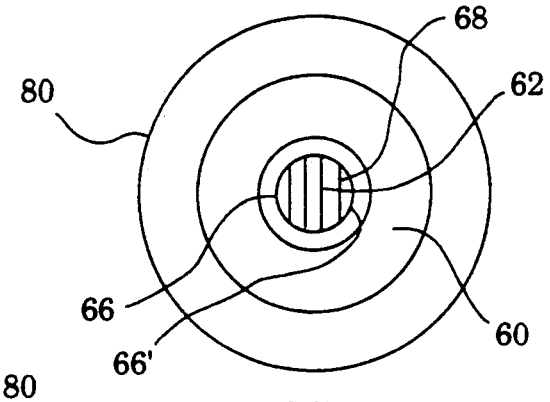
FIG. 4 is a plan view of FIG. 3.
Figure 5:
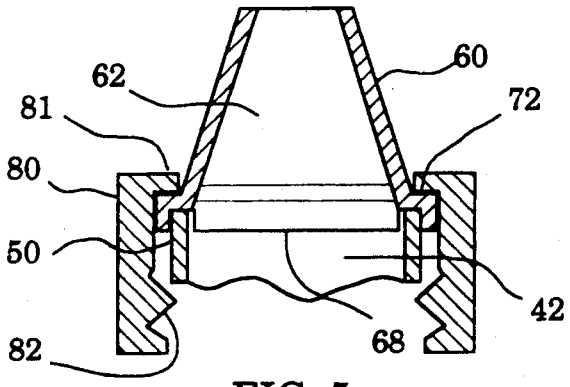
FIG. 5 is a view along the line 5—5 of FIG. 3.

FIG. 4 is a plan view of FIG. 3 illustrating the juxtaposed apertures 66, 66' formed in the spout 60 by the divider 62. The first side 68 of the divider 62 is also visible through the apertures 66, 66'. FIG. 5 is a view along the line 5—5 of FIG. 3 illustrating the divider 62 of the spout 60. The first end 68 of the divider fits over the edge (FIG. 3) of the inner wall 42.

Returning to FIG. 3, it is seen that the juxtaposed apertures 66, 66' are formed by the spout 60 and the divider 62. The width of the divider 62 at the apertures 66, 66' is limited so that flowable materials are dispensed in touching association. The materials respond to the force of gravity after dispensement from the apertures 66, 66' and this response, if the divider 62 is sufficiently narrow, causes them to share a common boundary. The juxtaposition of the apertures 66, 66' allows the effect of gravity to bring the materials together. It has been found that materials having the viscosity of mustard, ketchup and mayonnaise will be dispensed in touching association when the width of the divider 62 is less than ⅛ inch with a preferred width of less than 1/16 inch.

Figure 6:
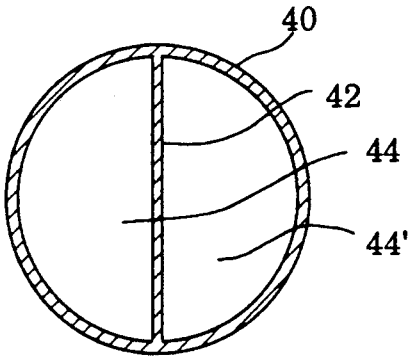
FIG. 6 is a sectional view along the line 6—6 of FIG. 2.
Figure 7:
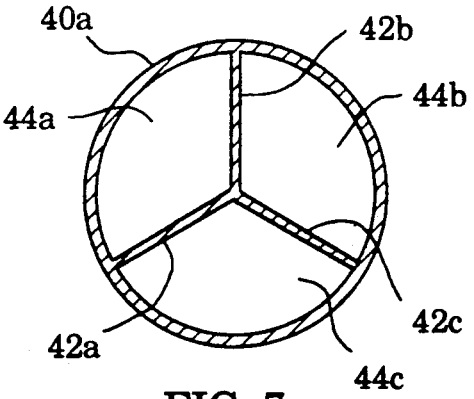
FIG. 7 is view similar to FIG. 6.

FIG. 6 is a sectional view along the line 6—6 of FIG. 2 showing the inner wall 42 dividing the container 40 into two compartments 44, 44'. FIG. 7 is a view similar to FIG. 6 illustrating an embodiment in which inner walls 42*a*, 42*b* and 42*c* would divide a container 40*a* into three compartments 44*a*, 44*b* and 44*c*. It will be apparent that the number of compartments may be varied as well as the comparative size of the compartments and the comparative size of the apertures 66, 66' (FIG. 3) without departing from the scope of the invention. It will also be apparent that the cross sectional shape of the dispenser 30 may be varied from the cylindrical shape illustrated without departing from the scope of the invention.

Figure 9:
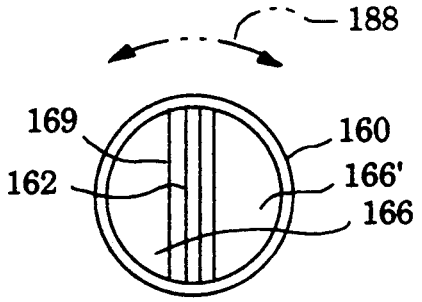
FIG. 9 is an enlarged view along the line 9—9 of FIG. 8.
Figure 8:
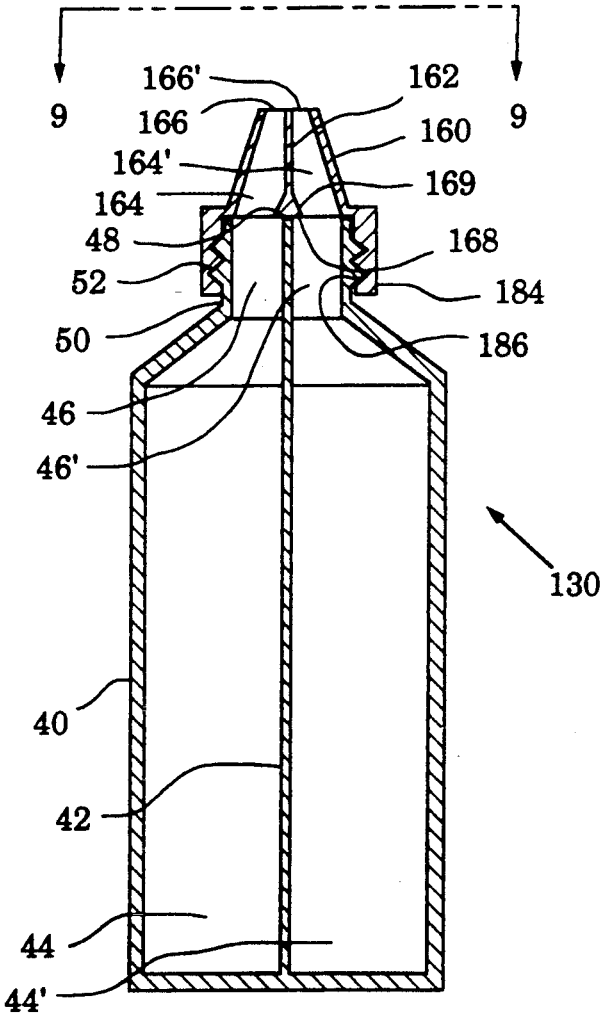
FIG. 8 is a sectional elevation view, in accordance with another embodiment of the present invention, of a dispenser.

FIG. 8 is an elevation view, in accordance with another embodiment of the current invention, illustrating a dispenser 130. The dispenser 130 has a spout 160 with a divider 162 that forms two passageways 164, 164' terminating in two apertures 166, 166'. The spout 160 has a collar 184 with threads 186 which engage the threads 52 on the neck 50 of the container 40. The divider 162 has a first side 168 that abuts the edge 48 of the inner wall 42. The first side 168 widens in a base 169. As can be seen in FIG. 9, which is an enlarged view along the line 9—9 of FIG. 8, the spout 160 can move in the circumferential direction 188 without the edge 48 (FIG. 8) being uncovered by the base 169. Thus, when the spout threads 186 and the neck threads 52 are fully engaged the first side 168 will align with the edge 48 despite unavoidable manufacturing tolerances in the spout 160 and the container 40.

Figure 10:
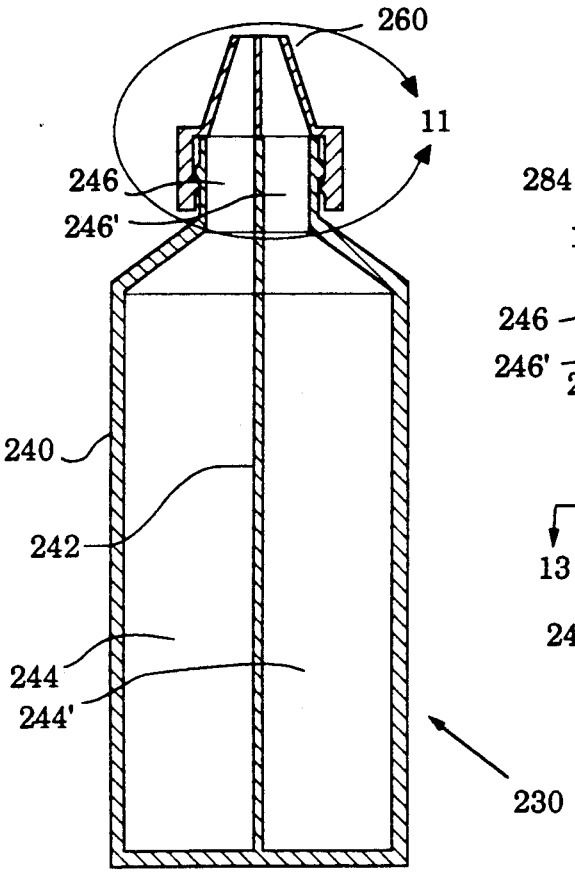
FIG. 10 is a sectional elevation view, in accordance with another embodiment of the present invention, of a dispenser.
Figure 11:
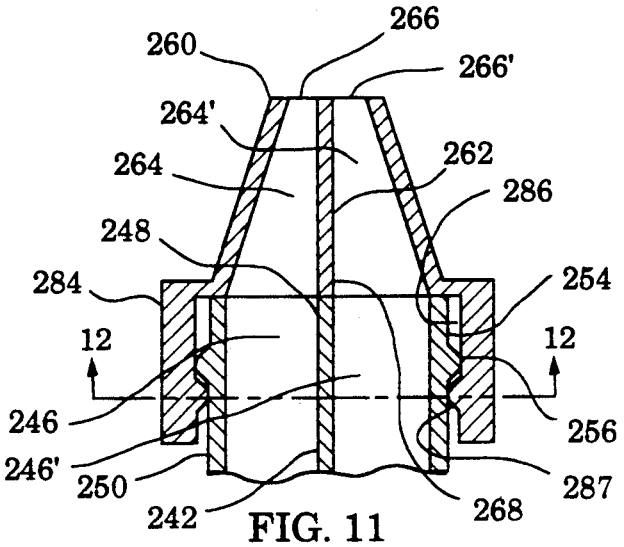
FIG. 11 is an enlarged view of the area enclosed by the line 11 of FIG. 10.

FIG. 10, in accordance with another embodiment of the present invention, is a sectional elevation view of a dispenser 230. The dispenser 230 has a resilient container 240 and a resilient spout 260. The container 240 is divided into compartments 244, 244' having outlets 246, 246' by an inner wall 242. FIG. 11 is a view of the area enclosed by the line 11 of FIG. 10 illustrating the spout 260 having a divider 262 defining two passageways 264, 264' terminating in two apertures 266, 266'. The divider 262 has a first side 268 which abuts the edge 248 of the inner wall 242.

The spout 260 has a collar 284 which has an inner surface 286 upon which is a circumferential bead 287. The neck 250 of the container 240 has an outer surface 254 with a circumferential ridge 256. The resilience of the container 240 and the spout 260 allows the spout to be pressed down to a position where the bead 287 snaps over the ridge 256 thus removably mounting the spout 260 on the container 230.

Figure 12:
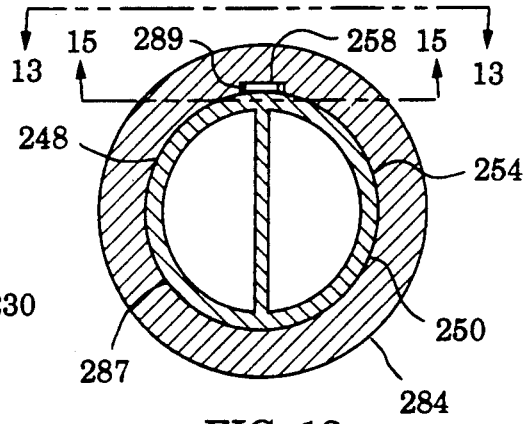
FIG. 12 is a view along the line 12—12 of FIG. 11.
Figure 13:
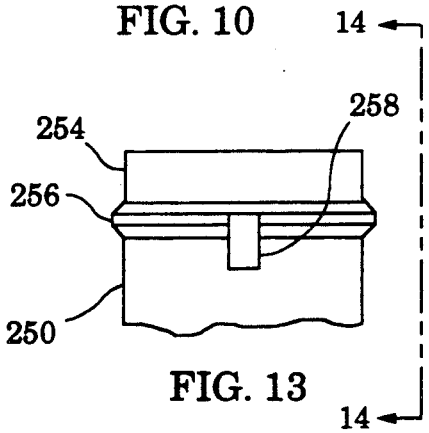
FIG. 13 is a view along the line 13—13 of FIG. 12.
Figure 14:
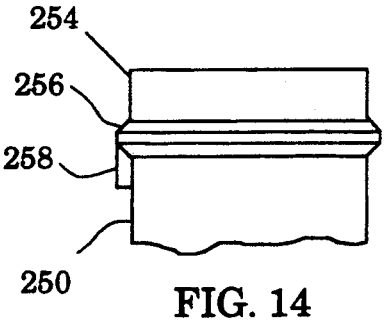
FIG. 14 is a view along the line 14—14 of FIG. 13.
Figure 15:
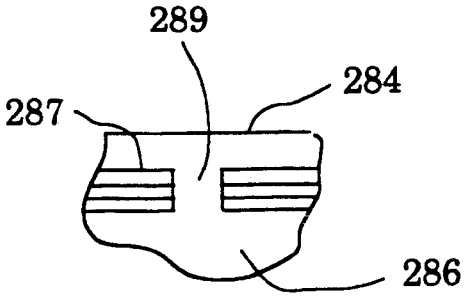
FIG. 15 is a view along the line 15—15 of FIG. 12.

FIG. 12 is a sectional view along the line 12—12 of FIG. 11 showing a relief 289 in the bead 287 that matches a tab 258 on the neck 250. The relief 289 and the tab 258 provide for alignment of the divider 262 and the wall 242. FIG. 13, which is a view along the line 13—13 of FIG. 12 illustrates the tab 258 and the ridge 256 on the outer surface 254 of the neck 250. FIG. 14 is a view along the line 14—14 of FIG. 13 and further illustrates the tab 258 and the ridge 256. FIG. 15 is a partial view along the line 15—15 of FIG. 12 illustrating the bead 287 and the relief 289 on the inner surface 286 of the collar 284. When the relief 289 matches the tab 258 as shown in FIG. 12, the apertures 266, 266' are aligned with the outlets 246, 246'.

Figure 16:
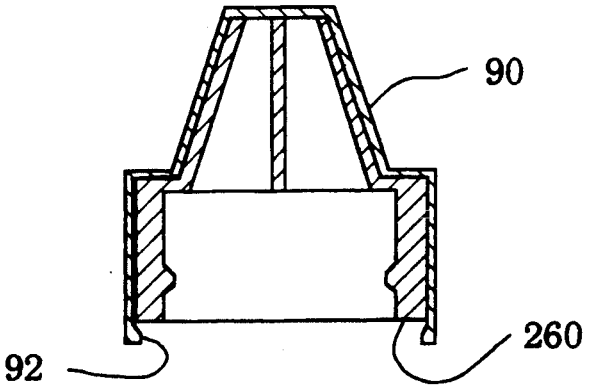
FIG. 16 is an elevation view of an environmental cap.

FIG. 16 illustrates a cap 90 that may be used as an environmental seal against dust, insects, odors and other outside contaminants for the dispenser embodiments 30, 130 and 230. It was not shown on the embodiments for clarity of illustration. The cap 90 is shown installed on the spout 260 of the dispenser 230 and is used in a similar manner on the spout 60 and rim 80 of the dispenser 30 and the spout 160 of the dispenser 130.

Figure 17:
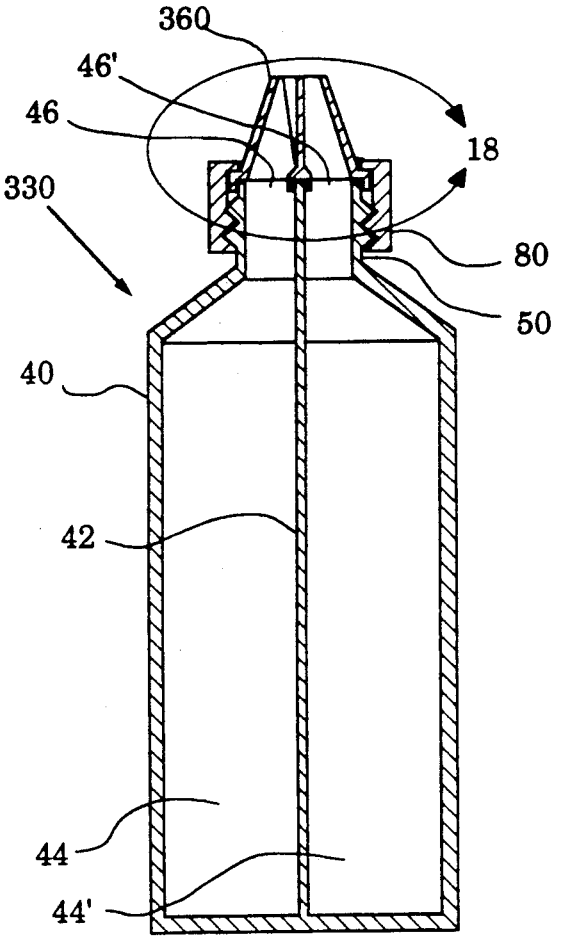
FIG. 17 is a sectional elevation view, in accordance with another embodiment of the present invention, of a dispenser.
Figure 18:
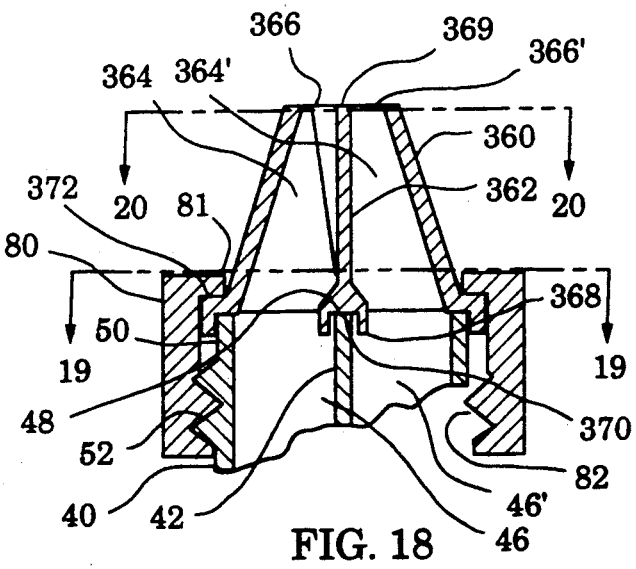
FIG. 18 is an enlarged view of the area enclosed by the line 18 of FIG. 17.

FIG. 17 illustrates, in accordance with another embodiment of the current invention, a sectional elevation view of a dispenser 330. The dispenser 330 has a container 40, a spout 360 and a ring 80. The ring 80 and the container 40 are as described for the dispenser 30 of FIG. 2. FIG. 18 is a view along the line 18—18 of FIG. 17 showing an enlarged sectional view of the spout 360. The spout 360 has a divider 362 that defines passageways 364, 364' leading to apertures 366, 366'. The divider 362 has a first side 368 with a recess 370 which receives the edge 48 of the wall 42. The divider 362 has a second side 369 which defines a portion of the apertures 366, 366'. The spout 360 has a step 372 that is urged against the container 40 by the ring 80.

Figure 20:
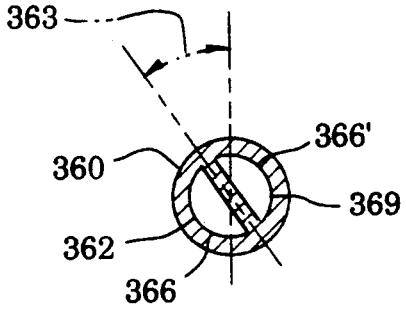
FIG. 20 is a view along the line 20—20 of FIG. 18.
Figure 19:
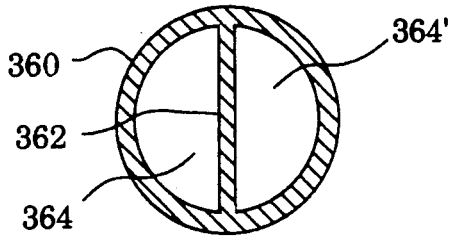
FIG. 19 is a view along the line 19—19 of FIG. 18.

FIG. 19 is a view along the line 19—19 of FIG. 18 while FIG. 20 is a view along the line 20—20 of FIG. 18. The transverse divider 362 is seen, in FIG. 20, to rotate by an angle 363 relative to its transverse position, along the line 19—19, shown in FIG. 19. Thus the second side 369 is radially offset from the first side by the angle 363. The effect of this twist in the divider 362 is to lend interesting variations in the juxtaposition of the dispensed materials from the apertures 366, 366'. The effects have been observed for an angle 363 in a range between 45 degrees and 5 degrees with a preferred range between 30 degrees and 10 degrees and a most preferred range of between 20 degrees and 15 degrees. These effects also vary depending on the angle with which the dispenser 360 is held relative to the surface upon which the materials are dispensed from the compartments 44, 44'.

Figure 21:
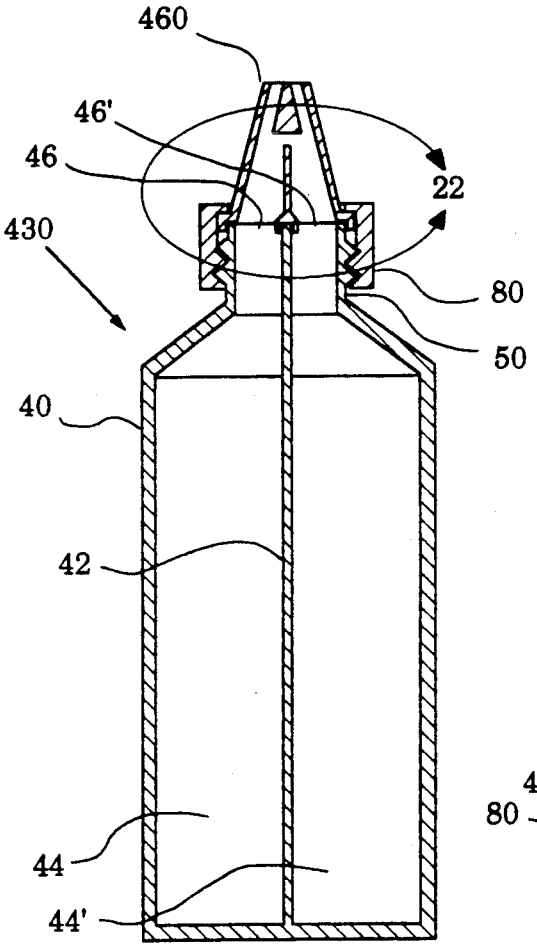
FIG. 21 is a sectional elevation view, in accordance with another embodiment of the present invention, of a dispenser.
Figure 23:
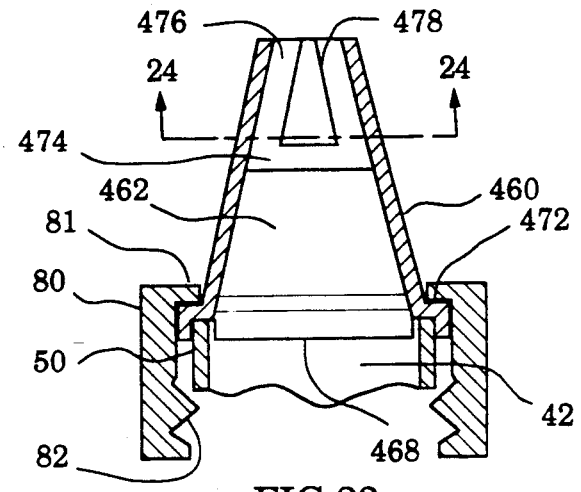
FIG. 23 is a view along the line 23—23 of FIG. 22.
Figure 22:
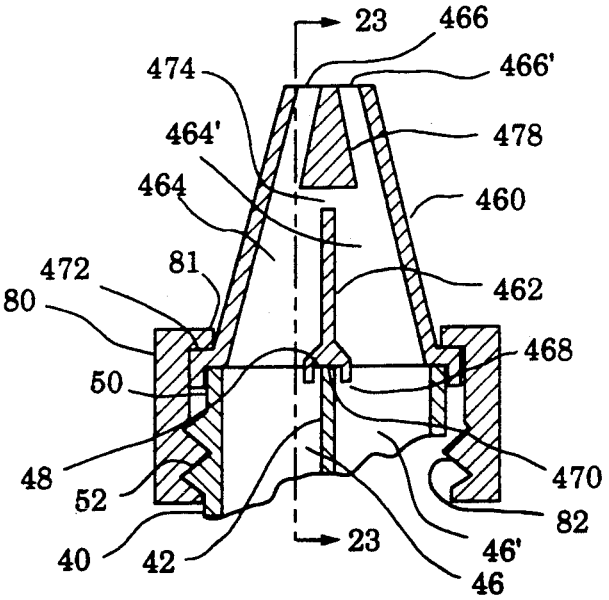
FIG. 22 is an enlarged view of the area enclosed by the line 22 of FIG. 21.

FIG. 21 illustrates, in accordance with another embodiment of the current invention, a sectional elevation view of a dispenser 430 which has a container 40, a spout 460 and a ring 80. The ring 80 and the container 40 are as described for the dispenser 30 of FIG. 2. FIG. 22 is an enlarged view of the area enclosed by the line 22 of FIG. 21. FIG. 23 is a view along the line 23—23 of FIG. 22 while FIG. 24 is a view along the line 24—24 of FIG. 23.

Figure 24:
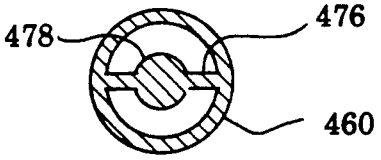
FIG. 24 is a view along the line 24—24 of FIG. 23.

As seen in FIGS. 22, 23 and 24, the spout 460 has a divider separated by a gap 474 into a first divider 462 and a second divider 476. The second divider 476 supports a truncated cone 478. The dividers 462, 476 define passageways 464, 464' and apertures 466, 466'. The spout 460 has a step 472 which the ring 80 urges against the container 40.

Figure 25:
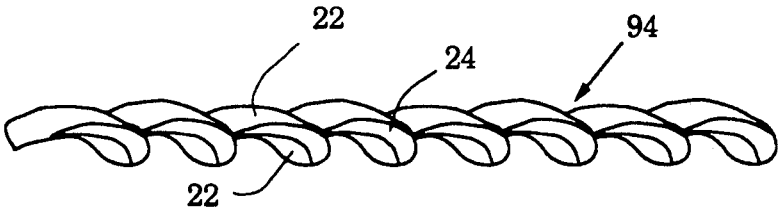
FIG. 25 is a plan view of a pattern similar to a dispensed material pattern from the dispenser of FIG. 21.

The spout 460 has been found to dispense materials of different viscosities from the compartments 44, 44' onto a surface in a pattern similar to the pattern 94 shown in FIG. 25 where the two materials are designated 22, 24. This pattern varies with the relative viscosities and the pressure applied to the container 40. The gap 474 has a width in the range of ½ inch to 1/32 inch with a preferred range of ¼ inch to 1/16 inch and a most preferred range of 3/16 inch to ⅛ inch.

Figure 26:
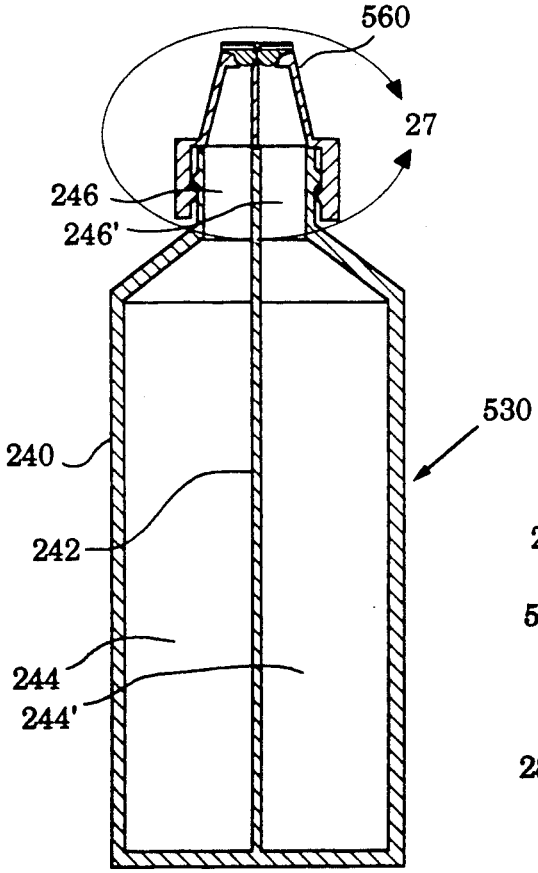
FIG. 26 is a sectional elevation view, in accordance with another embodiment of the present invention, of a dispenser.

FIG. 26 is a sectional elevation view, in accordance with another preferred embodiment of the present invention, of a dispenser 530. The dispenser 530 is similar to the dispenser 230 but has provisions for dispensing one material at a time in addition to dispensing two materials in touching association. Mounted on the container 240, which was described above in connection with the dispenser 230, is a spout 560.

Figure 27:
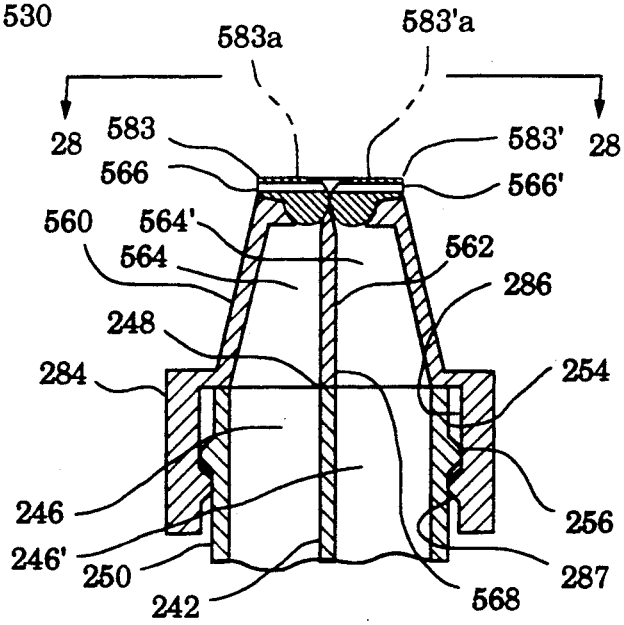
FIG. 27 is an enlarged view of the area enclosed by the line 27 of FIG. 26.

FIG. 27 is an enlarged view of the area enclosed by the line 27—27 of FIG. 26 illustrating the spout 560. The spout 560, similar to the spout 260 of FIG. 11 has a collar 284 which mates with the container 240. The collar 284 and its mating with the container 240 was described above and illustrated in FIGS. 11 through 15. The spout 560 may be covered with a cap 90 as was discussed above for the spout 260 and illustrated in FIG. 16.

Figure 28:
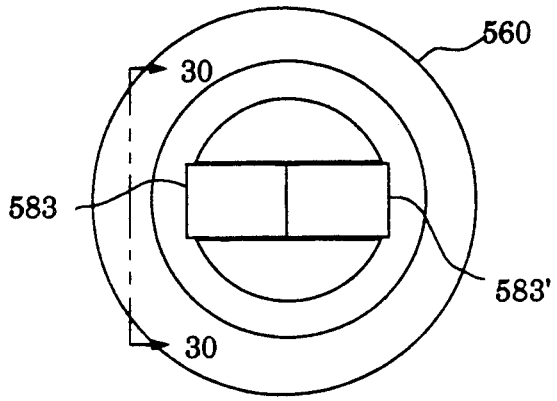
FIG. 28 is a view along the line 28—28 of FIG. 27.

In addition to the features of the spout 260, the spout 560, as shown in FIG. 27, has a pair of doors 583, 583' which, in the closed positions **583*a*, 583'*a*, cover the passageways 564, 564'. FIG. 28 is a view along the line 28—28 of FIG. 27 showing the doors 583, 583', on the spout 560**, to have a substantially rectangular shape.

Figure 29:
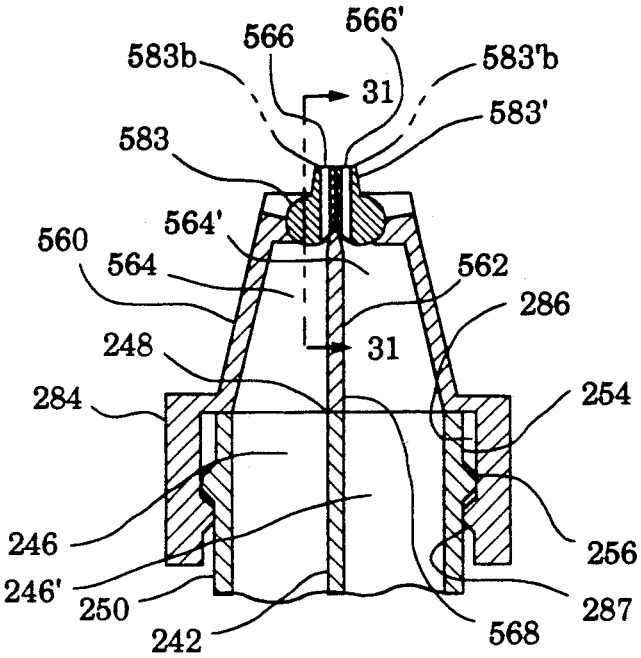
FIG. 29 is a view similar to FIG. 27.

FIG. 29 is a view similar to FIG. 27 in which the doors 583, 583' are shown in the open positions **583*b*, 583'*b*. The apertures 266, 266' of the spout 260 (FIG. 11) are replaced in the spout 560 with apertures 566, 566' in the doors 583, 583'. In this position of the doors 583, 583' materials may be dispensed from the apertures 566, 566' in touching association as was described above for the dispenser 230. If either door 583, 583' is swung to the position 583*a* or 583'*a*, as illustrated in FIG. 27, only one material will be dispensed. When in the open position 583*b*, 583'*b*, as shown in FIG. 29, the apertures 566, 566' form a continuation of the divider 562 so that materials can be dispensed from the compartments 244, 244' (FIG. 26**) in touching association.

Figure 30:
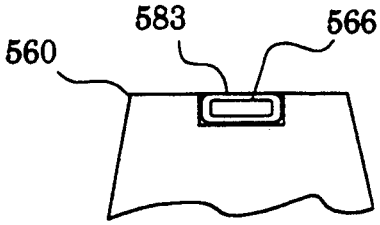
FIG. 30 is a view along the line 30—30 of FIG. 28.
Figure 31:
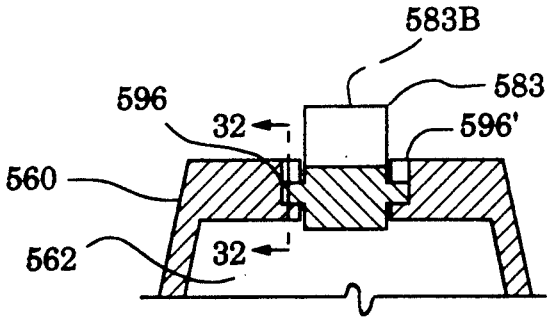
FIG. 31 is a view along the line 31—31 of FIG. 29.
Figure 32:
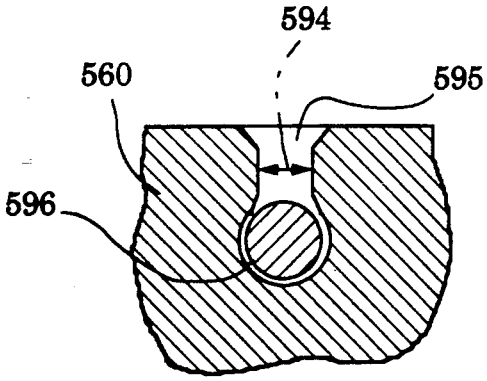
FIG. 32 is a view along the line 32—32 of FIG. 31.

FIG. 30 is a view along the line 30—30 of FIG. 28 illustrating the door 583 and the aperture 566 within. FIG. 31 is a view along the line 31—31 of FIG. 29 showing the bosses 596, 596' on the door 583 that turn within the spout 560. In FIG. 32, which is a view along the line 32—32 of FIG. 31, the boss 596 is seen to rotate within an indentation 595. The indentation 595 has a restriction 594. The spout 560 is made of resilient material so that the boss 596 may be pressed through the restriction 594 to the position shown in FIG. 32 where it is free to rotate.

Dispensers with juxtaposed apertures have thus been provided for dispensing materials onto a surface in touching association. A dispenser has also been provided having this capability and, when desired, the capability to dispense one material at a time. Materials for which these capabilities may be convenient include mustard, relish, ketchup, and mayonaisse, peanut butter and jelly, syrups, salad dressings and shampoo/conditioner combinations. Many other combinations may be devised by the user.

It will be apparent that the present invention has been described with reference to preferred embodiments and that numerous modifications and rearrangements thereof can be made with the equivalent result still embraced within the scope of the invention.

What is claimed is:

1. A dispenser comprising:

a resilient container having at least one inner wall defining at least two compartments in said resilient container, each of said compartments having an outlet, said outlets juxtaposed so that pressure applied to said resilient container causes any flowable materials stored in said compartments to dispense from said outlets, a spout having at least one divider defining at least two passageways, each of said passageway terminating in an aperture, said apertures being juxtaposed, means for removably mounting said spout on said container, means for aligning the passageways with said outlets so that flowable materials dispensed from said outlets thereby flow through said passageways and dispense from said apertures in a touching association, said removable spout allowing said outlets to be of sufficient area to facilitate inserting flowable materials responsive to pressure applied to the resilient container into said container when the spout is removed therefrom; and means for sealing said spout from the environment when said dispenser is not in use for dispensing flowable materials, said inner wall has an edge defining a portion of said outlets;

said spout divider is divided by a gap into a first divider and a second divider; said first divider having a first side abutting said wall edge, said second divider having a first side adjacent said gap and having a truncated cone centered within said spout with the large diameter of said cone adjacent said first side of the second divider, said second divider defining a portion of said apertures.

2. A dispenser comprising:

a resilient container having at least one inner wall defining at least two compartments in said resilient container, each of said compartments having an outlet, said outlets juxtaposed so that pressure applied to said resilient container causes any flowable materials stored in said compartments to dispense from said outlets, a spout having at least one divider defining at least two passageways, each of said passageway terminating in an aperture, said apertures being juxtaposed, means for removably mounting said spout on said container, means for aligning the passageways with said outlets so that flowable materials dispensed from said outlets thereby flow through said passageways and dispense from said apertures in a touching association, said removable spout allowing said outlets to be of sufficient area to facilitate inserting flowable materials responsive to pressure applied to the resilient container into said container when the spout is removed therefrom; and said inner wall has an edge defining a portion of said outlets;

said spout divider is divided by a gap into a first divider and a second divider; said first divider having a first side abutting said wall edge, said second divider having a first side adjacent said gap and having a truncated cone centered within said spout with the larger diameter of said cone adjacent said first side of the second divider, said second divider defining a portion of said apertures.

* * * * *